US006018846A

United States Patent [19]

Huang

[11] Patent Number: 6,018,846

[45] Date of Patent: Feb. 1, 2000

[54] SAFETY HINGE MECHANISM FOR FOLDABLE PLAY YARD

[76] Inventor: Sieno Tsung-Ming Huang, No. 26, Lane 348, Chu-Lin Rd, Lin Kou Hsiang, Taipei Hsien, Taiwan

[21] Appl. No.: 08/969,566

[22] Filed: Nov. 13, 1997

[51] Int. Cl.[7] ..... A47D 7/00; E05D 11/10

[52] U.S. Cl. ..... 16/332; 16/327; 5/99.1

[58] Field of Search ..... 16/324–331, 347, 16/332; 403/102, 106, 325; 5/99.1

[56] References Cited

U.S. PATENT DOCUMENTS

| | | | |
|---|---|---|---|
| 5,457,828 | 10/1995 | Huang | 403/102 |
| 5,560,055 | 10/1996 | Ziegler | 5/99.1 |
| 5,561,874 | 10/1996 | Malofsky et al. | 5/99.1 |

*Primary Examiner*—Chuck Y. Mah
*Assistant Examiner*—Donald M. Gurley
*Attorney, Agent, or Firm*—Bacon & Thomas

[57] ABSTRACT

The present invention relates to a safety hinge mechanism for foldable play yard and that is used to pivotally connect a first frame rod and a second frame rod thereof. The connecting bracket can be selectively rotated along the longitudinal axis of the frame rod into a locking position, or a neutralized position. A locking device is provided and disposed onto any one of the first and second frame rods. The locking device can be moved along the longitudinal direction into a locked position, or a released position. Wherein in the locked position, the locking device is engaged with the connecting bracket and the connecting bracket is prevented from any rotational movement thereof. As a result, the first and second frame rods are allowed to fully extend while they are not allowed to fold together. However, when the locking device and the connecting bracket are disengaged, the connecting bracket is rotated to a neutralized position and the first and second frame rods can be folded in a side-by-side manner. By the provision of the locking device, the hinge mechanism can be readily locked and the possibility of being incidentally released during the usage can be therefore prevented. A durable hinge mechanism for foldable play yard is therefore provided.

2 Claims, 7 Drawing Sheets

SAFETY HINGE MECHANISM FOR FOLDABLE PLAY YARD

FIELD OF THE INVENTION

The present invention relates to a safety hinge mechanism, more particularly, to a safety hinge mechanism for the foldable play yard. The safety hinge mechanism can be used to connect two adjacent frame rods such that those two frame rods can be selectively disposed side-by-side or horizontally extended.

DESCRIPTION OF PRIOR ART

In the foldable play yard, a joint mechanism is applied to connect two adjacent frame rods to facilitate the folding of those frame rods. U.S. Pat No. 4,934,025, entitled "Hinge For A Center Fold Play Yard", has suggested a rotational positioning mechanism between the frame rod and the joint. The frame rod and the joint are relatively positioned by means of ratchet teeth. However, during the operation of the joint, the frame rod shall be firstly pushed toward the joint to release the ratchet teeth, then the frame rod can be pivotally rotated with respect to the joint and the frame rod can be extended or folded respect to the joint. However, after a period of usage, the ratchet teeth may by worn and its normal function will be impaired.

U.S. Pat. No. 5,457,828 entitled "Joint Of A Playpen" comprises two locating blocks 200, two locating sockets 300, 3 14, and a control block 100. The control block 200 is provided with a projected pin 240 that is eccentrically and resiliently disposed. The projected pin 240 can be engaged with the cutout 308 of the locking barrel 300 to selectively folding the playpen. However, the projected pin 240 is quite small and is disposed at the side portion of the joint and which faces downward. Accordingly, it is quite inconvenient in use.

U.S. Pat. Nos. 5,211,498 entitled "Folding Joint For A Foldable Play Yard"; 5,239,714 entitled "Playpen Structure", and 5,279,006 entitled "Play Yards For Infants" have all disclosed a joint mechanism. Even those joint mechanisms can be used for folding and unfolding the frame rods of the play yard, it is not provided with a safeguard. As a result, the joint can be readily moved from the locked position to a released position such that the play yard is folded while the infant is still in there.

DESCRIPTION OF PRIOR ART

It is the objective of this invention to provide a safety hinge mechanism for foldable play yard. The safety hinge mechanism includes a connecting bracket which is used to pivotally connect a first frame rod and a second frame rod thereof. The connecting bracket can be selectively rotated along the longitudinal axis of the frame rod into a locking position, or a neutralized position. A locking device is provided and disposed onto any one of the first and second frame rods. The locking device can be moved along the longitudinal direction into a locked position, or a released position. Wherein in the locked position, the locking device is engaged with the connecting bracket and the connecting bracket is prevented from any rotational movement thereof. As a result, the first and second frame rods are allowed to fully extend while they are not allowed to fold together. However, when the locking device and the connecting bracket are disengaged, the connecting bracket is rotated to a neutralized position and the first and second frame rods can be folded in a side-by-side manner. By the provision of the locking device, the hinge mechanism can be readily locked and the possibility of being incidentally released during the usage can be therefore prevented. A durable hinge mechanism for fordable play yard is therefore provided.

DETAILED DESCRIPTION OF PREFERRED EMBODIMENT

Figure 6:
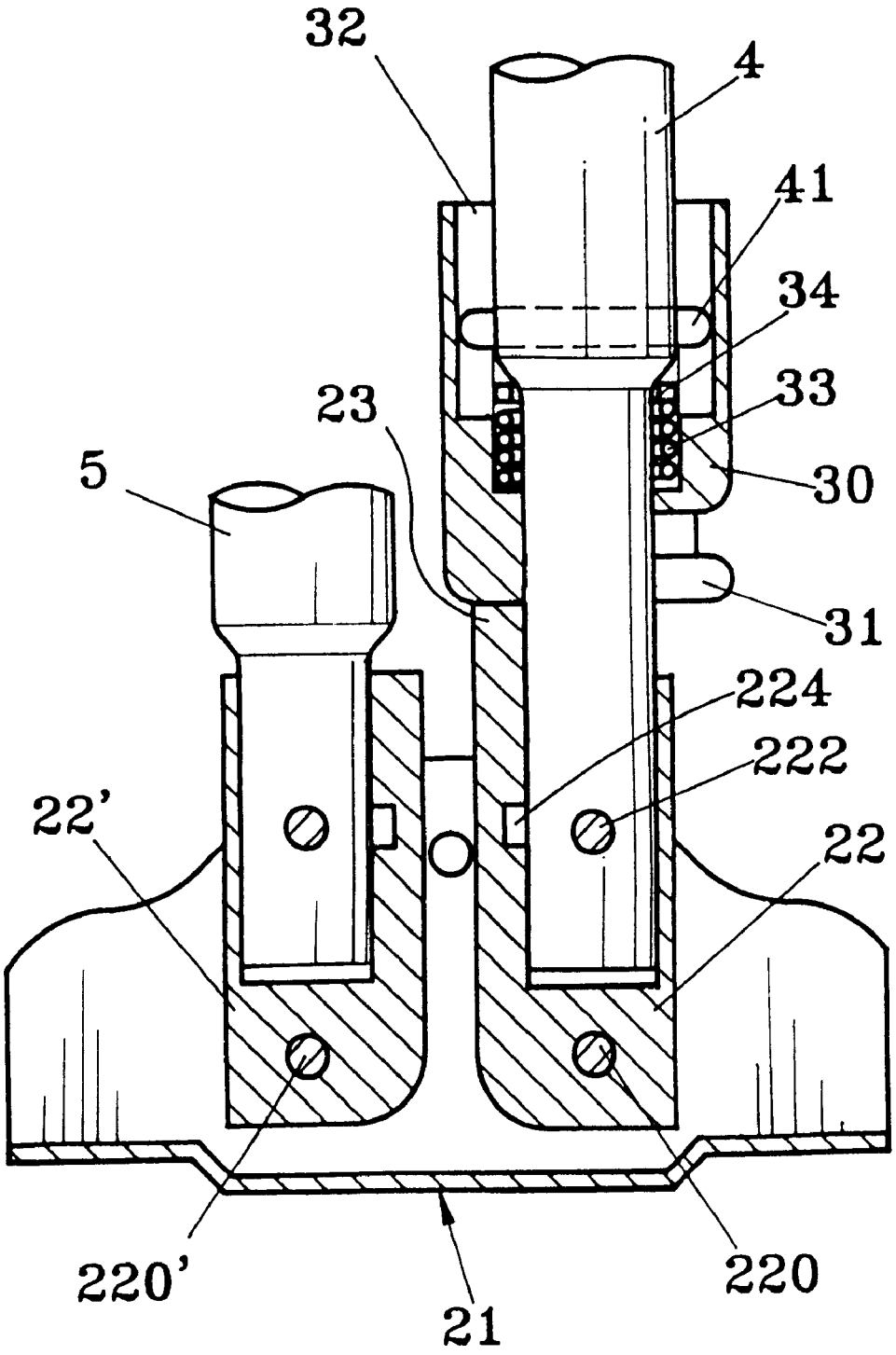
FIG. 6 is a still schematic illustration showing the frame of the play yard is folded.
Figure 9:
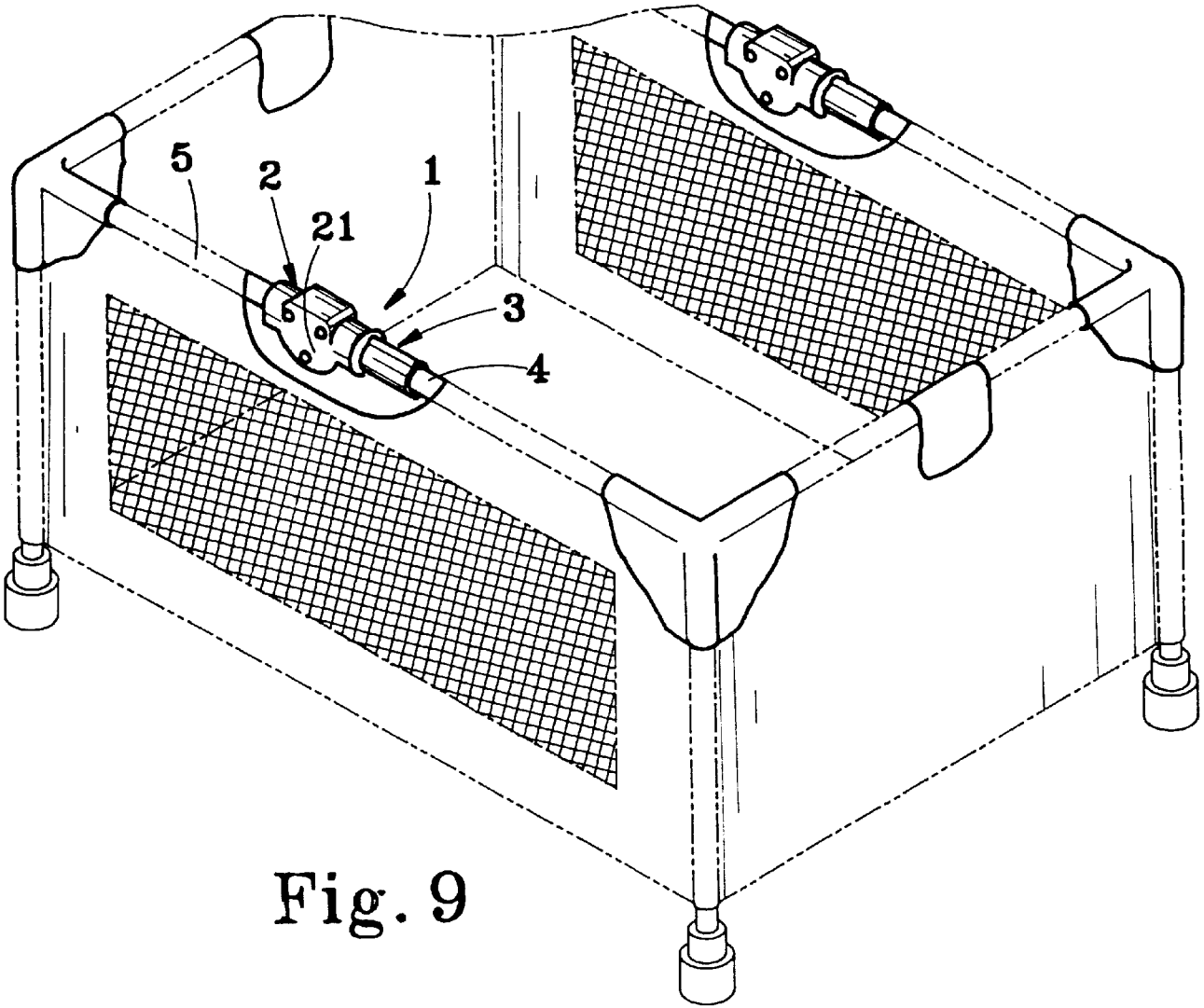
FIG. 9 is a schematic illustration showing the safety hinge mechanism is applied on the play yard.

As shown in FIG. 9, the safety hinge mechanism 1 is used to connect the first frame rod 4 and the second frame rod 5 that are adjacent to each other. By this arrangement, the first and second frame rods 4, 5 can be selected to be kept at a first position as shown in FIG. 9, wherein the play yard are fully extended, or at a second position as shown in FIG. 6, wherein the play yard are compactly retracted.

Figure 3:
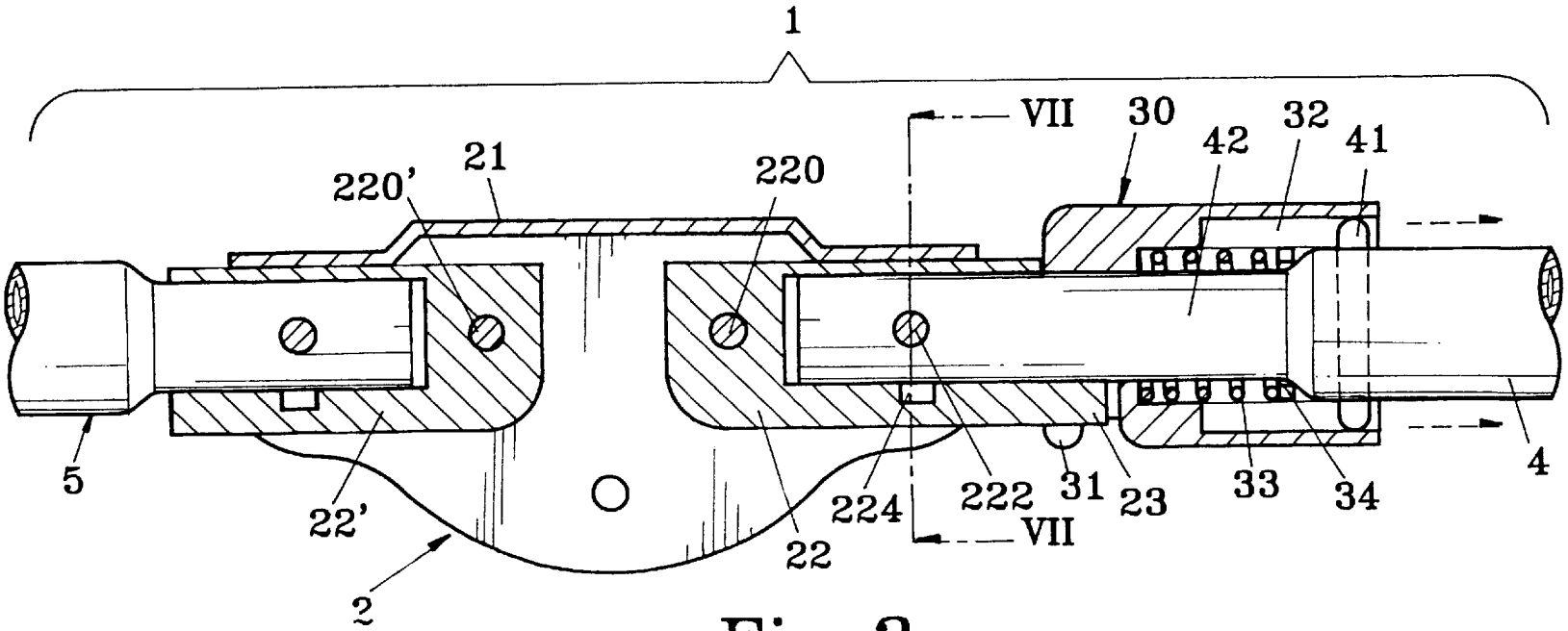
FIG. 3 is a cross sectional view of the shaft.
Figure 5:
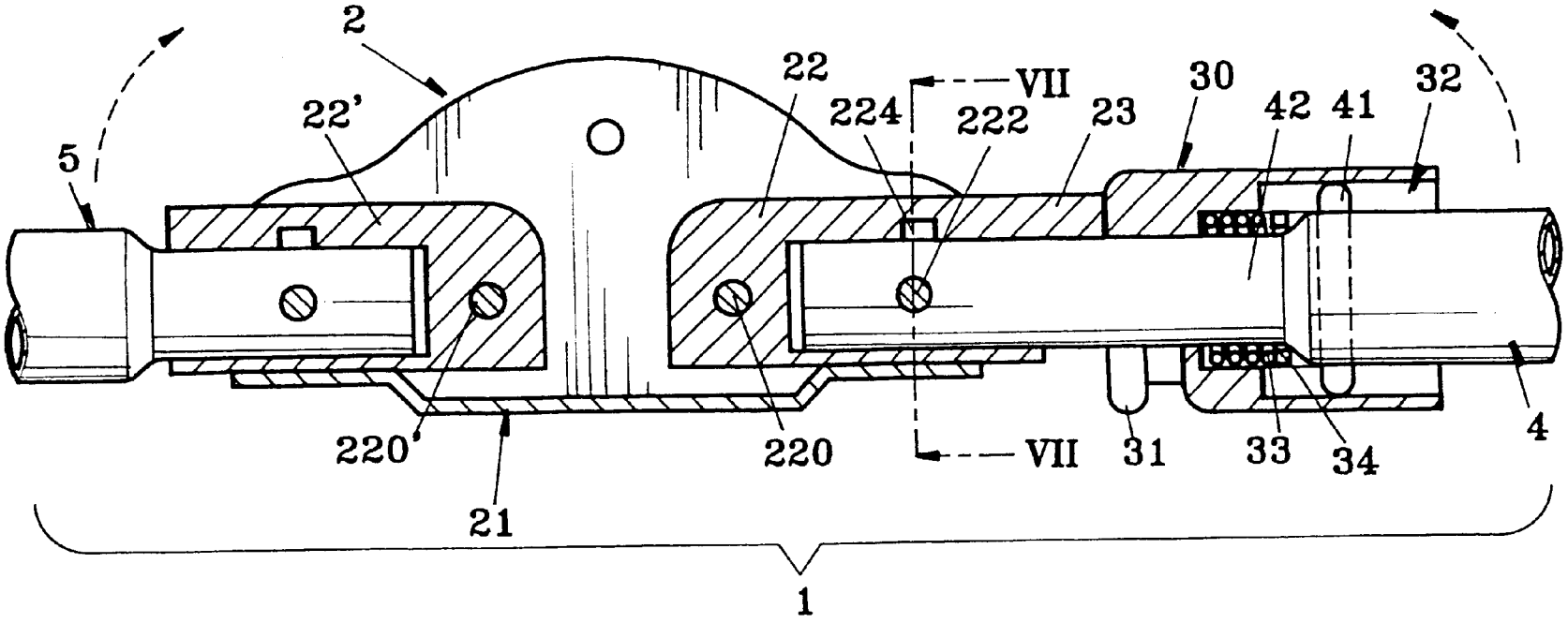
FIG. 5 is another schematic illustration of the connecting bracket that is moved to a neutralized position.

Referring to FIG. 3, a cross sectional view of the hinge mechanism is shown. The safety hinge 1 generally comprises a connecting bracket 2, which is used to connected the first frame rod 4 and the second frame rod 5. The connecting bracket 2 can be selectively rotated along the longitudinal axis of the frame rod into a locking position, as shown in FIG. 3, or a neutralized position, as shown in FIG. 5. A locking device 3 is provided and disposed onto any one of the first and second frame rods 4 and 5. The locking device 3 can be moved along the longitudinal direction into a locked position, as shown in FIG. 3, or a released position, as shown in FIG. 5.

Figure 1:
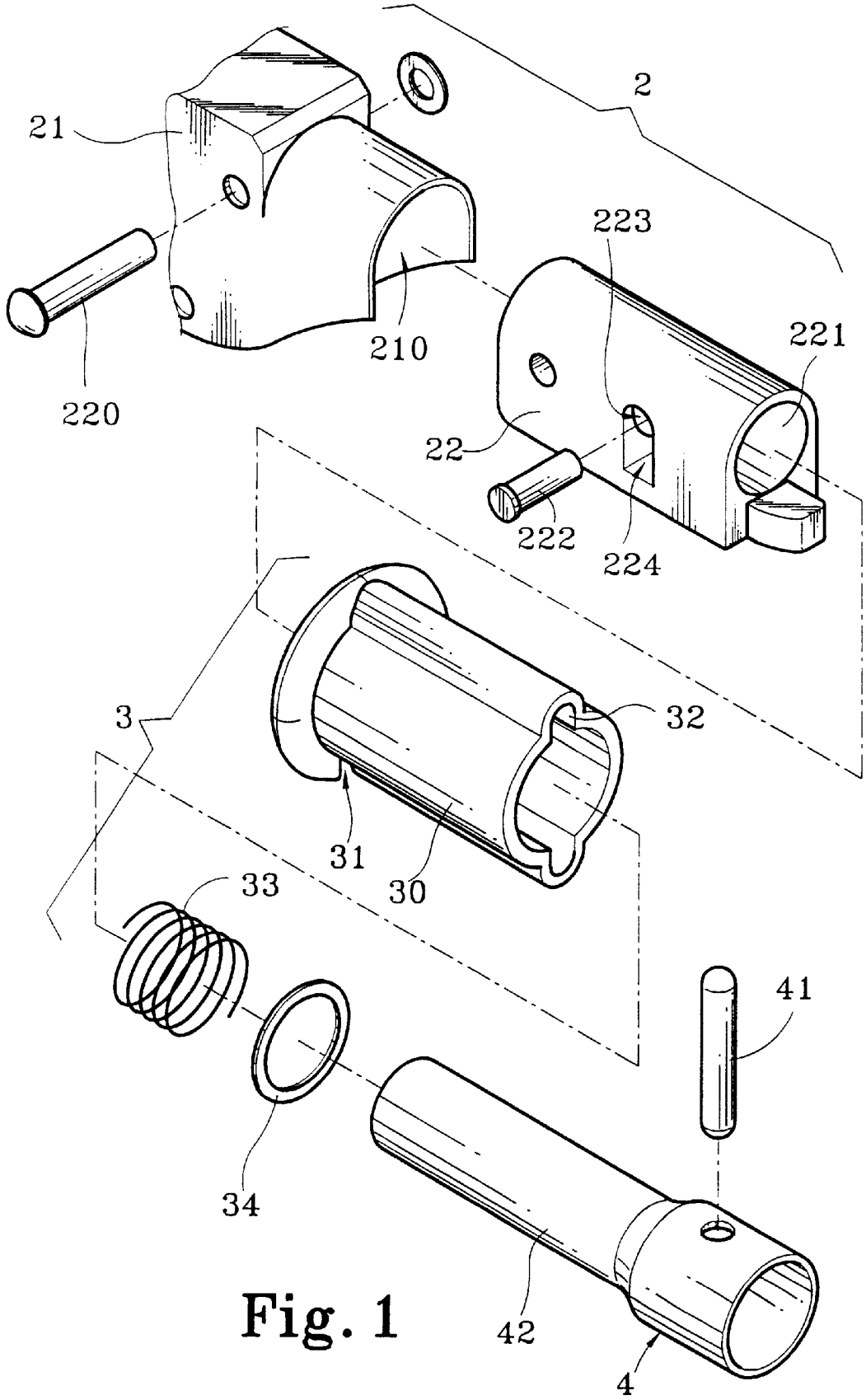
FIG. 1 is a partial, perspective view of the safety hinge mechanism made according to the present invention.

As shown in FIGS. 1 and 3, the connecting bracket 2 includes a rotating-controlling element 21, a first positioning block 22 for the first frame rod 4, and a second positioning block 22' for the second frame rod 5. The rotating-controlling element 21 has a horseshoeshape and which defines an opening 210 for receiving the first and second positioning blocks 22, 22' respectively. By this arrangement, when the first and second frame rods 4 and 5 are respectively and pivotally connected to the connecting bracket 2, the rotation of each of the first and second frame rods 4 and 5 is limited to a direction which directs toward the opening 210 of the rotating-controlling element 21. As a result, those first and second frame rods 4 and 5 can be disposed side by side.

The first and second positioning blocks 22 and 22' are pivotally installed onto the rotating-controlling element 21 by means of the pin shafts 220, 220', respectively. The first and second positioning blocks 22 and 22' are symmetrically configured. The only difference is that the first positioning block 22 is provided with a retaining dowel 23 that can be releasably engaged with the locking device 3. However, the second positioning block 22' is not provided. Accordingly, the following description will be focused onto the first positioning block 22.

Figure 8:
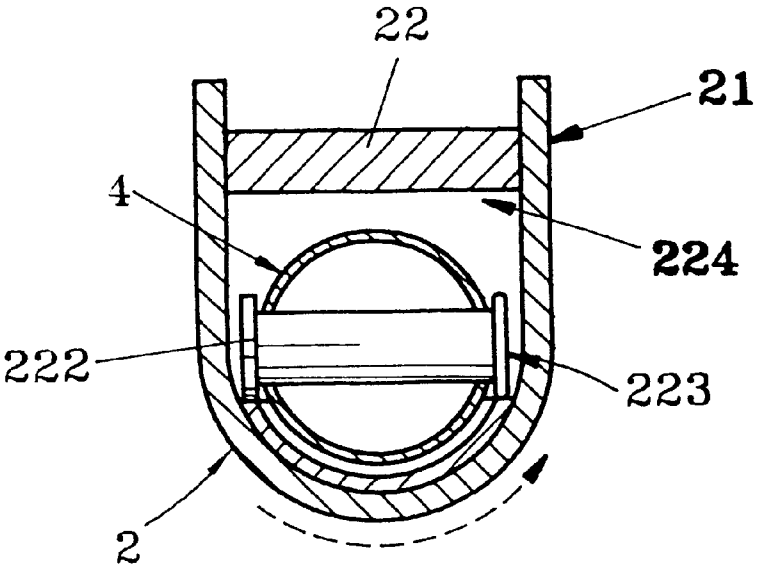
FIG. 8 is still a cross sectional view of taken from line VIII—VIII of FIG. 5.
Figure 7:
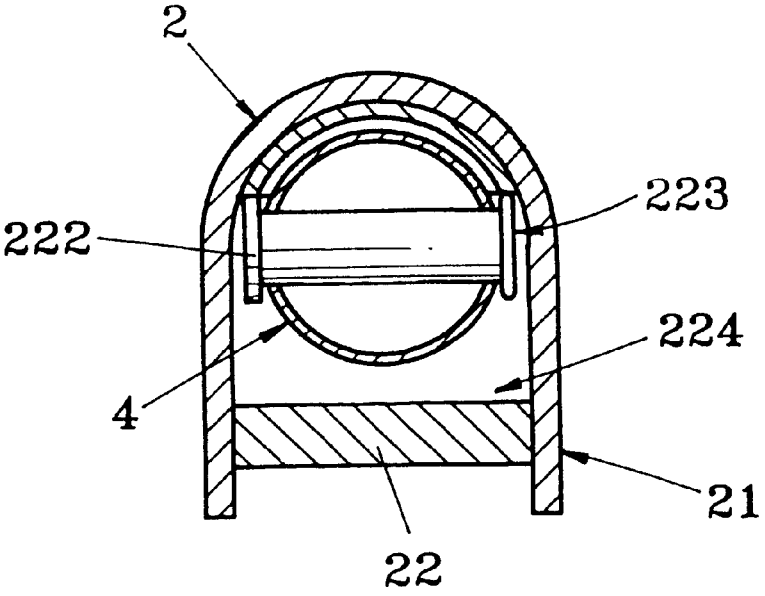
FIG. 7 is a cross sectional view taken from line VII—VII of FIG. 3.

The first positioning block 22 is axially provided with a receiving hole 221 and in which the first frame rod 4 is rotationally received within the receiving hole 221. A retaining pin 222 which passes through the radial hole 223 of the first positioning block 22 is applied to connect with the first positioning block 22. The radial hole 223 has a grove 224 at the lower end and which is tangent to the receiving hole 221. The groove 224 provides a 180 degrees of freedom of rotation to the retaining pin 222 when the first positioning block 22 is rotated respect to the rotating-controlling element 21, as clearly shown in FIGS. 7 and 8. When the rotating-controlling element 21 is rotated through 180 degrees, the rotating-controlling element 21 is rotated to a neutralized position, as shown in FIG. 5.

Figure 2:
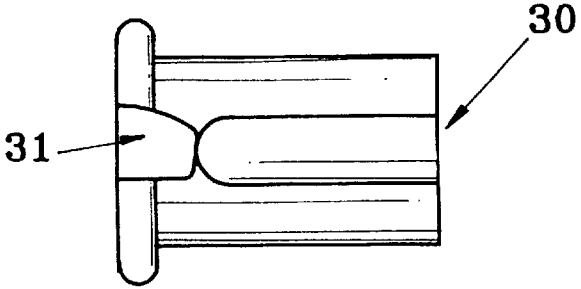
FIG. 2 is a bottom view of the locking mechanism.
Figure 4:
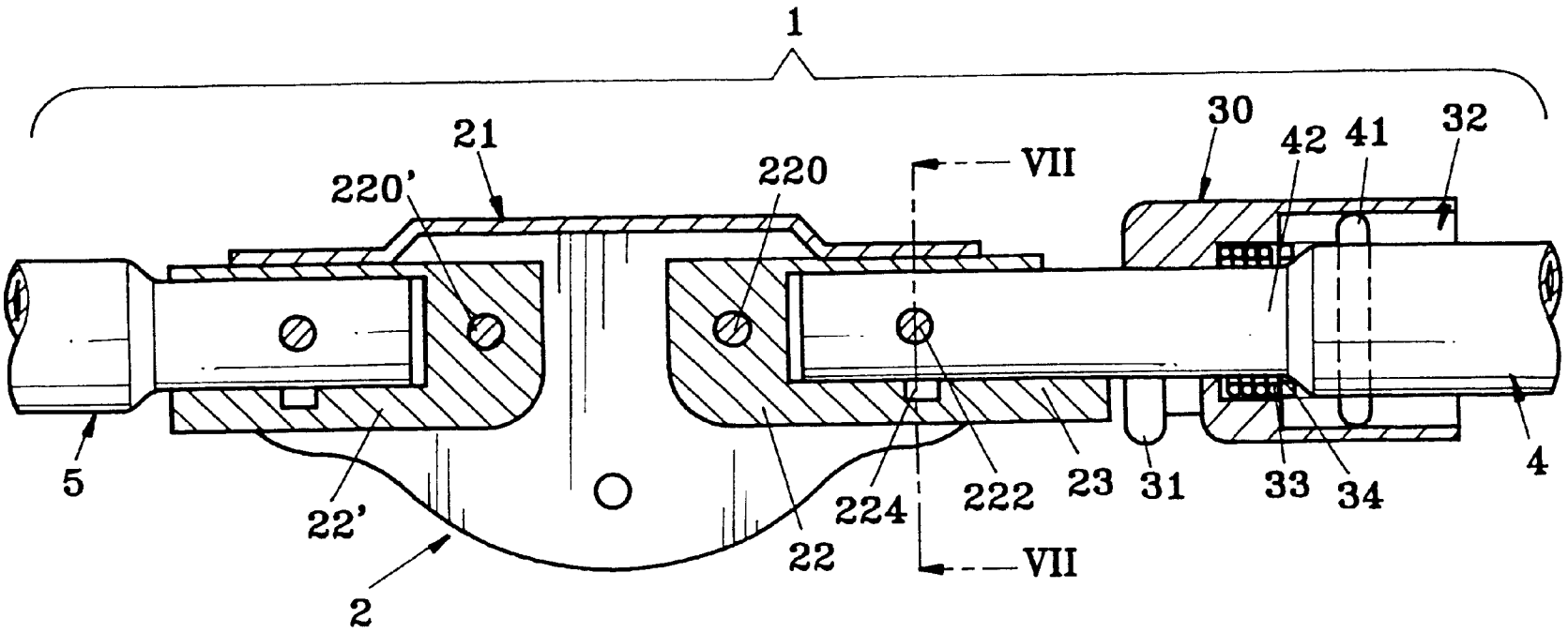
FIG. 4 is a schematic illustration of the shaft shown in FIG. 3, wherein the locking device is moved to a released position.

As shown in FIGS. 1 and 3, the locking device 3 includes a cylindrical barrel 30 that opens toward the first end of the first positioning block 22. The barrel 30 further includes a cutout 31 with which the retaining dowel 23 can be retained thereof, as shown in FIG. 2. The barrel 30 is moveably enveloped onto the first frame rod 4. Accordingly, the barrel 30 can be selectively moved from a first position, as shown in FIG. 3, in which the cutout 31 is engaged with the retaining dowel 23, to a second position, as shown in FIG. 4, in which the retaining dowel 23 is released from the cutout 31. The barrel 30 is not allowed to rotate with respect to the first frame rod 4. Therefore, the outer end of the barrel 30 is provided with a slot 32 and the first frame rod 4 is provided with a limiting pin 41 that directs axially at both ends. Both ends of the limiting pin 41 can be movably slid into the slot 32 such that the rotational movement of the barrel 30 is prevented. The locking device 30 is further provided with a compressible spring 33 that can be compressed axially, and a washer 34. The washer 34 and the compressible spring 33 are enveloped onto the front section 42 of the first frame rod 4 and which has a small outer diameter. The other end of the spring 33 is biased into the inner portion of the barrel 30. By the firm support of the washer 34, the cutout 31 of the barrel 30 is pushed into a position that is engaged with the retaining dowel 23.

When both the first and second frame rods 4 and 5 are extended and positioned horizontally, as clearly shown in FIG. 9, the locking device 3 is pushed by the compressible spring 33 and into the position as shown in FIG. 3. In this case, the cutout 31 is engaged with the retaining dowel 23 and the rotating-controlling element 21 is fixedly disposed at the locked position. During the normal use of the play yard, a downward force may exert onto the first and second frame rods 4 and 5 and the rotating-controlling element 21 is not allowed to rotate. Consequently, the first and second frame rods 4 and 5 are prevented from being pivotally rotated along its rotating point. To the contrary, when the barrel 30 is moved to the released position, as shown in FIG. 4, the retaining dowel 31 is then released from the cutout 31 and the rotating-controlling element 21 is rotated to the neutralized position, as shown in FIG. 5. In this event, the first and second frame rods 4 and 5 are allowed to rotate to a position that both frame rods 4 and 5 are disposed side by side, as clearly shown in FIG. 6. By this provision, a safety hinge mechanism is provided.

What I claim is:

1. A safety hinge mechanism for a foldable play yard of the type which is used to connect any two configuring rods which are adjacent to each other, said hinge mechanism comprising:

a connecting bracket including a rotating-controlling element, a first positioning block, and a second positioning block, said rotating-controlling element having a horseshoe cross section which defines an opening thereof, said first and second positioning blocks being pivotally disposed respectively therein;

said first and second positioning blocks being provided with an axial receiving hole and said first and second frame rods being rotationally received within said receiving holes respectively, one of said first or second positioning blocks being provided with a retaining dowel at a first end that extends outward and axially away from said controlling element;

a locking device including a cylindrical barrel mounted on said first rod that opens toward the first end of said one positioning block, said barrel further including a cutout axially opening toward said one positioning block with which said retaining dowel can be retained therein, said barrel being moveably enveloped onto said first frame rod such that said barrel can be selectively moved from a first position in which said cutout is engaged with said retaining dowel to a second position in which said retaining dowel is released from said cutout, the inner surface of said barrel being provided with two axially extending slots and said first frame rod being provided with a transversely extending limiting pin that projects at both ends, both ends from said first frame rod of said limiting pin being movably slid into said slots such that the rotational movement of said barrel relative to said first frame rod is prohibited, wherein when said connecting bracket is locked by said locking device, said first and second frame rods are prohibited to pivot toward each other, and wherein when said connecting bracket is released by said locking device as said locking device is moved to a neutralized position, said connecting bracket is allowed to pivot to a neutralized position and said first and second frame rods are allowed to pivot toward each other and into a folded position.

2. A safety hinge mechanism for foldable play yard as claimed in claim 1, wherein said locking device is further provided with a compressible spring that can be compressed axially, and a washer, said washer and said compressible spring are enveloped onto said first frame rod, the other end of said spring is biased into the inner portion of said barrel, by the firm support of said washer, said cutout of said barrel is pushed into a position that is engaged with said retaining dowel.

* * * * *